US009868497B2

(12) United States Patent
Ulgen

(10) Patent No.: US 9,868,497 B2
(45) Date of Patent: Jan. 16, 2018

(54) TORQUE BOOSTING PROPELLER DEVICE

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 825 days.

(21) Appl. No.: 14/460,923

(22) Filed: Aug. 15, 2014

(65) Prior Publication Data

US 2015/0367920 A1 Dec. 24, 2015

(30) Foreign Application Priority Data

Jun. 20, 2014 (TR) ..... U 2014 07214

(51) Int. Cl.

| | |
|---|---|
| ***B63H 1/20*** | (2006.01) |
| ***B63H 1/28*** | (2006.01) |
| ***B63H 5/10*** | (2006.01) |
| ***B63H 1/14*** | (2006.01) |

(52) U.S. Cl.

CPC ..... *B63H 5/10* (2013.01); *B63H 1/14* (2013.01); *B63H 2001/145* (2013.01)

(58) Field of Classification Search

CPC ... B63H 1/14; B63H 1/20; B63H 1/28; B63H 2001/283

USPC ..... 416/198 R

See application file for complete search history.

(56) References Cited

U.S. PATENT DOCUMENTS 529,916 A 11/1894 Jones
1,386,835 A * 8/1921 Birkett ..... B63H 1/28 440/66
3,528,382 A * 9/1970 Corlett ..... B63H 1/28 114/162
3,885,516 A * 5/1975 Uroshevich ..... B63B 35/7943 440/61 T
5,423,701 A * 6/1995 Rodskier ..... B63H 5/10 416/93 A
5,522,703 A * 6/1996 Okamoto ..... B63H 23/321 416/93 A
5,759,073 A * 6/1998 Sumino ..... B63H 1/28 440/66
5,766,047 A * 6/1998 Alexander, Jr. ..... B63H 5/10 416/129
6,062,926 A * 5/2000 Alexander, Jr. ..... B63H 5/10 416/129
8,444,391 B2 * 5/2013 Jonsson ..... B63H 1/20 416/244 B
8,459,950 B2 * 6/2013 Shuto ..... B63H 5/10 416/129
8,585,366 B2 * 11/2013 Shuto ..... B63H 5/10 416/129

(Continued)

*Primary Examiner* — Sean J Younger

(74) *Attorney, Agent, or Firm* — Vidas, Arrett & Steinkraus, P.A.

(57) ABSTRACT

A propeller device for a marine vehicle with a main shaft; a front propeller is provided on the main shaft, the front propeller having a hub and a plurality of blades extending radially outwardly from the hub; a rear propeller being co-axially to and spaced from the front propeller, the rear propeller having a hub and a plurality of blades extending radially outwardly from the hub. A second shaft being communicated with the hub of the front propeller; and at least one support for supporting the rear propeller on the second shaft, the support prevents the second shaft to rotate in the direction of rotation of the main shaft, and being free to rotate thereof in the counter direction of rotation of the main shaft.

10 Claims, 6 Drawing Sheets

(56) References Cited

U.S. PATENT DOCUMENTS

| | | | | |
|---|---|---|---|---|
| 8,641,463 | B2 * | 2/2014 | Shuto | B63H 5/10<br>440/80 |
| 2008/0089786 | A1 * | 4/2008 | Sinreich | B63H 5/10<br>416/129 |

* cited by examiner

TORQUE BOOSTING PROPELLER DEVICE

CROSS-REFERENCE TO RELATED APPLICATIONS

This Utility Patent Application claims priority to TR 2014/07214, filed on Jun. 20, 2014.

STATEMENT REGARDING FEDERALLY SPONSORED RESEARCH

Not applicable.

BACKGROUND OF THE INVENTION

The present invention relates to a propeller device boosting propeller shaft torque of a marine vessel. In particular, the present invention relates to a propeller device having dual propellers, wherein the pressurized water at the outlet of the front propeller spins the rear propeller which is locked in one direction of rotation so that the torque formed on the rear propeller is transmitted on the main shaft.

A marine vessel is impelled in the sea by a propeller which is communicated with the vessel's engine from one end and with the other end of a shaft connected to a transmission. The extent of the shaft torque is substantially influential on the movement capacity of the marine vessel, since it accelerates the propeller. In essence, the output torque of the shaft is a function of several variables, such as engine power, speed and transmission reduction. The propellers are conventionally designed as to meet the torque at the highest motor speed. In principal, a higher shaft torque requires a higher engine power, which increases the cost of fuel consumption.

A conventional approach for providing a better propeller thrust is to use a dual propeller structure, wherein the propellers are coaxially mounted on the shaft. The dual propeller structure is essentially based on the principle that the torque that is received from the shaft connected with the engine is transferred to a second shaft, with which the front propeller is communicated by means of a first power transfer means (for instance a gear wheel mechanism), and that the torque that is received from the shaft connected with the motor is transferred to a third shaft that is coaxial with the second shaft, the third shaft being communicated with the rear propeller by means of the second power transfer means. An exemplary arrangement for a dual propeller structure is disclosed in U.S. Pat. No. 6,821,169. Likewise, U.S. Pat. No. 6,702,631 and U.S. Pat. No. 6,478,641 disclose a dual propeller structure.

In the dual propeller structures mentioned in the above documents, the resultant thrust slightly increases as the torque that is necessary for rotating both propellers is provided by one power source, by the shaft communicated with the engine. This is because of the fact that two separate propeller devices entail two separate sources of energy loss. Thus, each propeller device has its own power transfer means, and they cause significant mechanical losses. Moreover, the rear propeller uses the water which has already been de-energized by the front propeller, causing a loss of efficiency.

BRIEF SUMMARY OF THE INVENTION

An object of the present invention is to provide a marine vessel propeller which improves the thrust efficiency of the propeller in an energy-active manner.

Another object of the present invention is to provide a convertible propeller, the thrust efficiency of which is improved.

The present invention relates to a propeller device for a marine vehicle comprising a main shaft that can be communicated with a drive engine of a marine vessel from one end; a front propeller provided on the main shaft, the front propeller having a hub and a plurality of blades extending radially outwardly from the hub; a rear propeller being co-axially to and spaced from the front propeller, the rear propeller having a hub and a plurality of blades extending radially outwardly from the hub. The device of the invention comprises a second shaft being communicated with the hub of the front propeller; and at least one support for supporting the rear propeller on the second shaft, the at least one support being not allow the second shaft to rotate in the direction of rotation of the main shaft, and being free to rotate thereof in the counter direction of rotation of the main shaft. Therefore, the accelerated water going out of the front propeller drives the rear propeller and when the support is not rotatable, the torque occurred on the axis of the second shaft is transferred to the front propeller body and thereby the torque of the front propeller is boosted. Thus, the kinetic energy of water at the rear end of the front propeller provides a gain of torque.

According to a preferred embodiment of the present invention, the second shaft comprises a flange extending radially outwardly from the second shaft so that the second shaft will be communicated with the propeller hub thereof; the flange being preferably monolithic with the second shaft.

When the marine vessel navigates rearward, the second propeller can rotate idly, and it does not pose a negative effect on the front propeller.

According to a preferred embodiment of the present invention, the rear propeller can be removed from the propeller device and an intermediate conic section in a form that excludes the rear propeller can be affixed. Therefore, the propeller device is converted to a conventional propeller, i.e. with one propeller and the vortex pressure of which is prevented at the propeller rear.

On the other hand, the propeller device according to the invention can be incorporated to the propellers when the conventional propeller "heavy" for the marine vessel because of the higher pitch thereof cannot reach its full speed, and therefore a propeller system having the desired higher torque and efficiency is achieved.

The present invention further relates to a marine vessel comprising a propeller device according to the present invention.

BRIEF DESCRIPTION OF THE SEVERAL VIEWS OF THE DRAWINGS

In order to understand the advantages of the present invention along with its embodiment and additional parts, it should be assessed together with the figures that are described in the following.

DETAILED DESCRIPTION OF THE INVENTION

Figure 1:
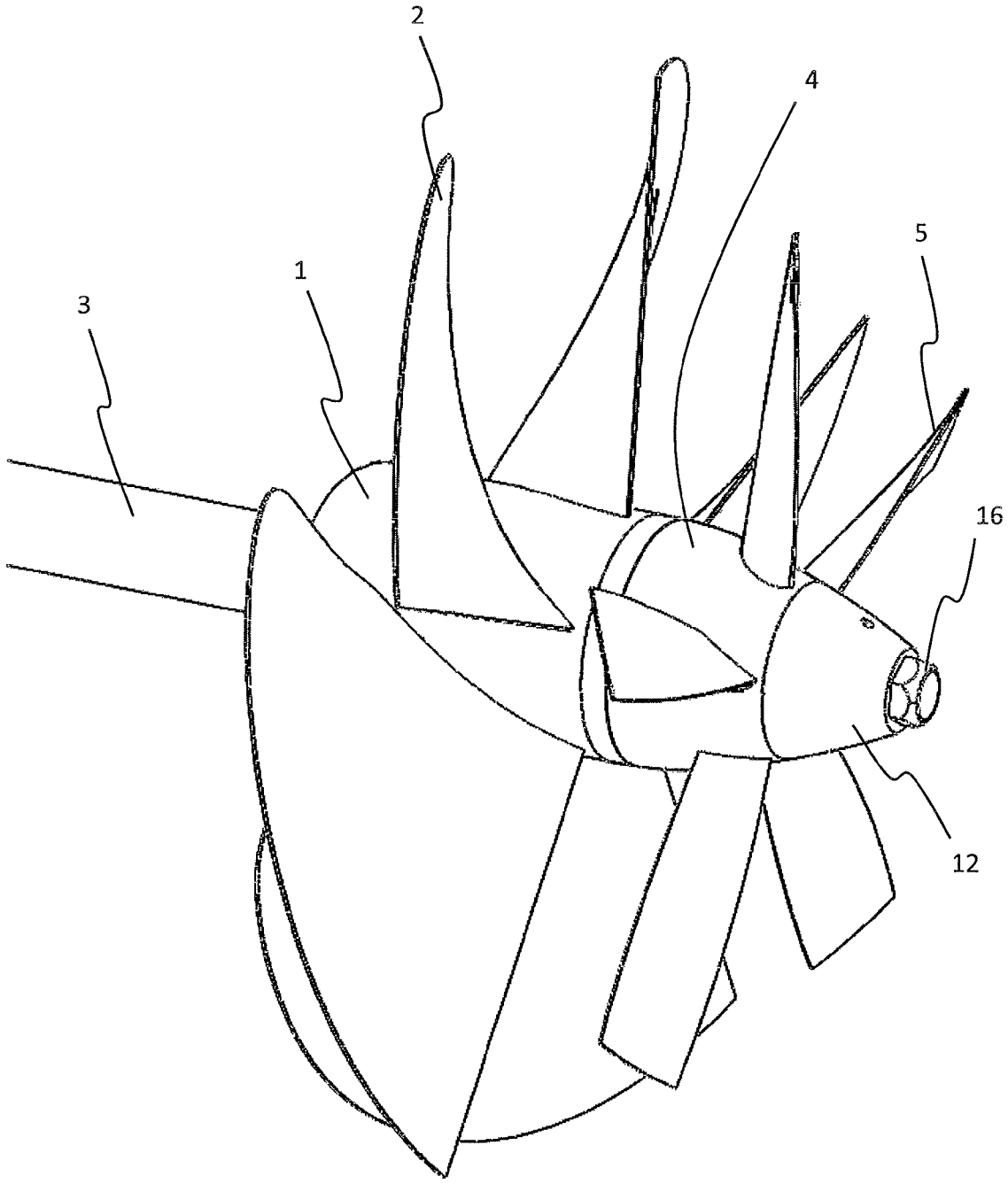
FIG. 1 shows a perspective view of the propeller device according to the present invention.
Figure 2:
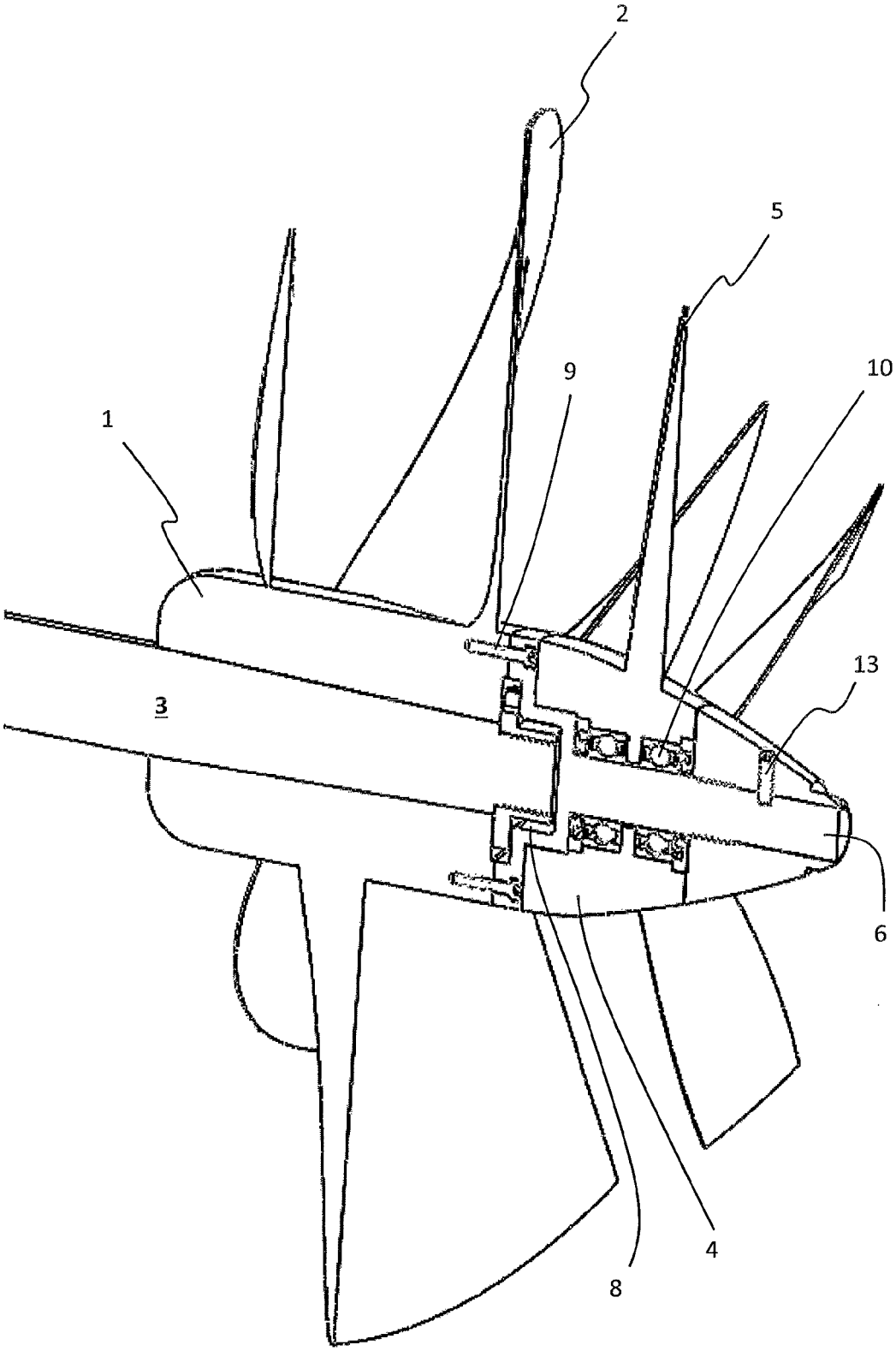
FIG. 2 shows the sectional perspective view of FIG. 1.
Figure 3:
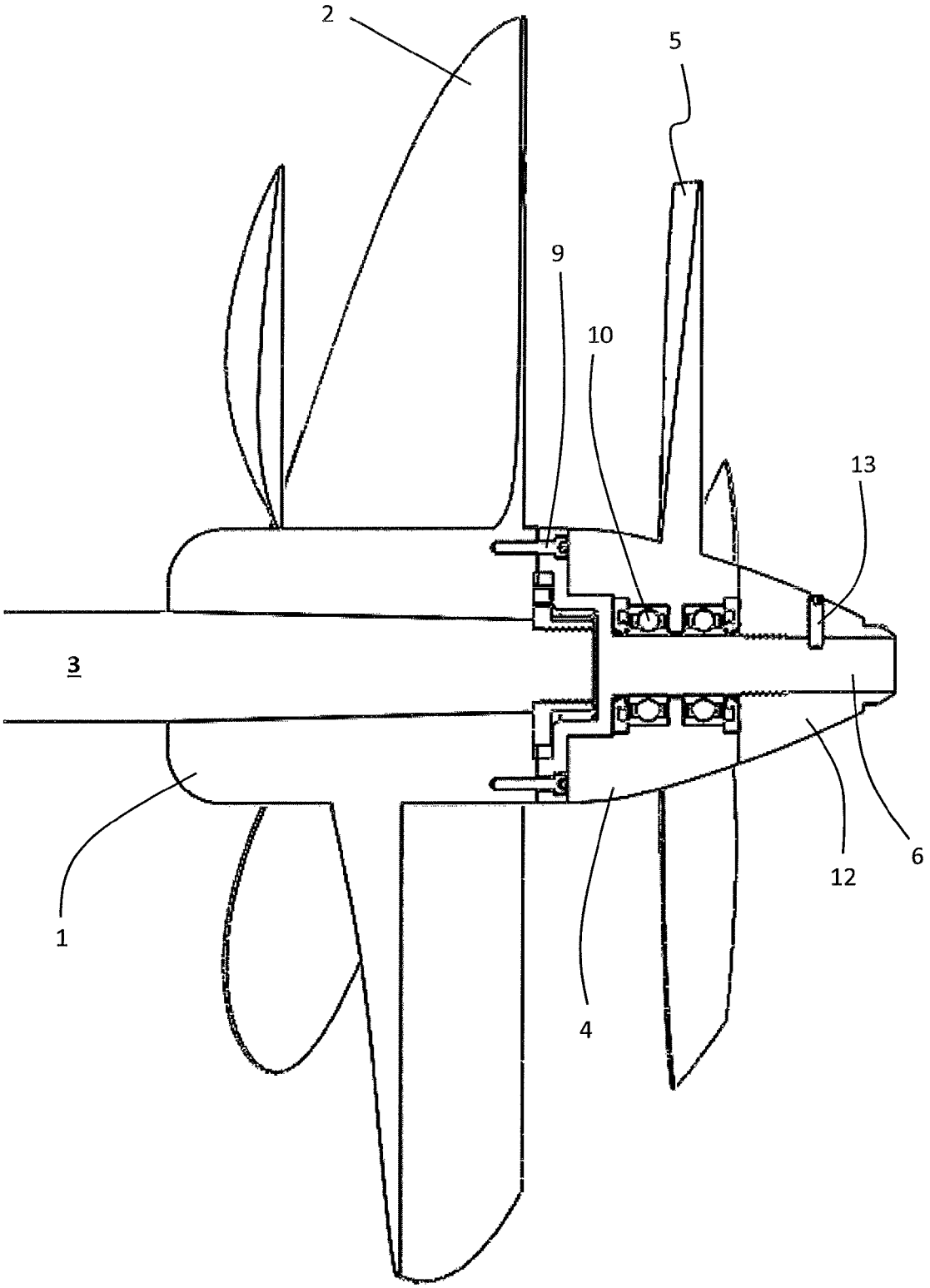
FIG. 3 shows the side view of FIG. 2.
Figure 4:
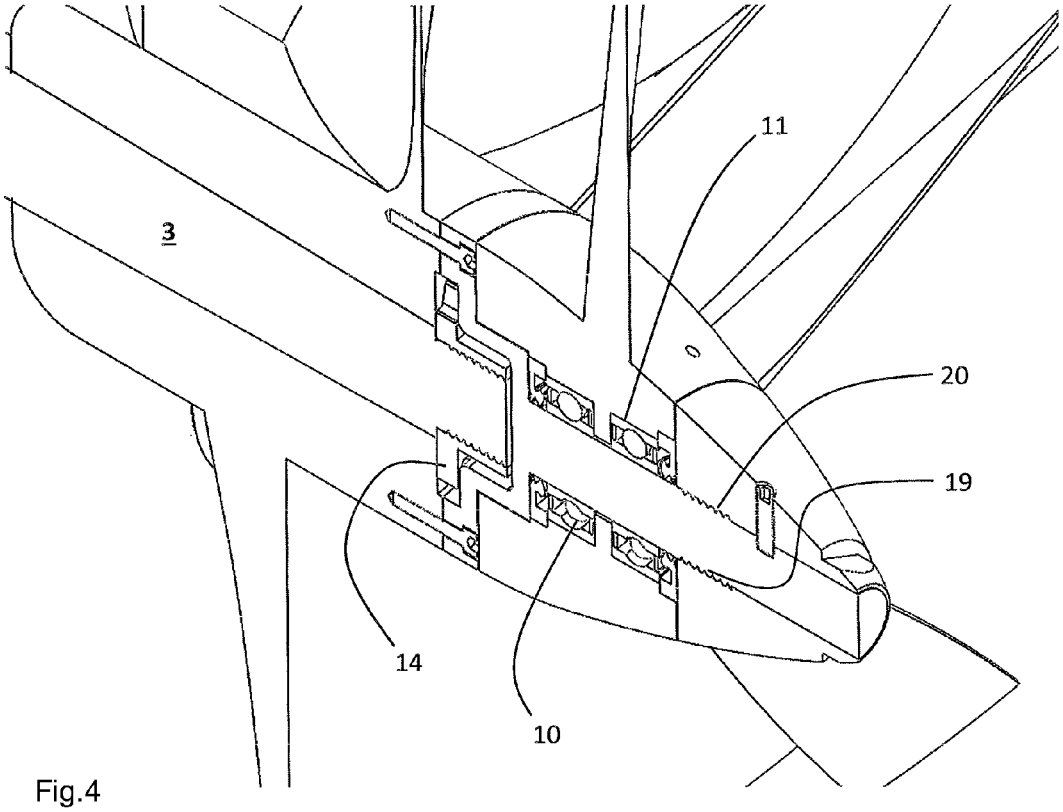
FIG. 4 shows a sectional perspective view of the propeller device according to the present invention.

While this invention may be embodied in many different forms, there are described in detail herein a specific preferred embodiment of the invention. This description is an exemplification of the principles of the invention and is not intended to limit the invention to the particular embodiment illustrated.

The torque-boosting propeller device according to the present invention comprises a front propeller and a rear propeller being arranged co-axially with the front propeller. The front propeller comprises a front propeller hub (1) and a plurality of front propeller blades (2) extending radially outwardly therefrom. The rear propeller, similarly comprises a rear propeller hub (4) and a plurality of rear propeller blades (5) extending radially outwardly therefrom.

The front propeller is rigidly mounted on a main shaft (3) connected to the engine of the marine vessel from one end. This connection is provided by screwing a nut (14) having a washer, on the inner part of which threads (18) are formed and which conforms with main shaft threads (17) that are formed on one end (i.e. the other end where the engine is not connected to) of the main shaft (3).

Figure 5:
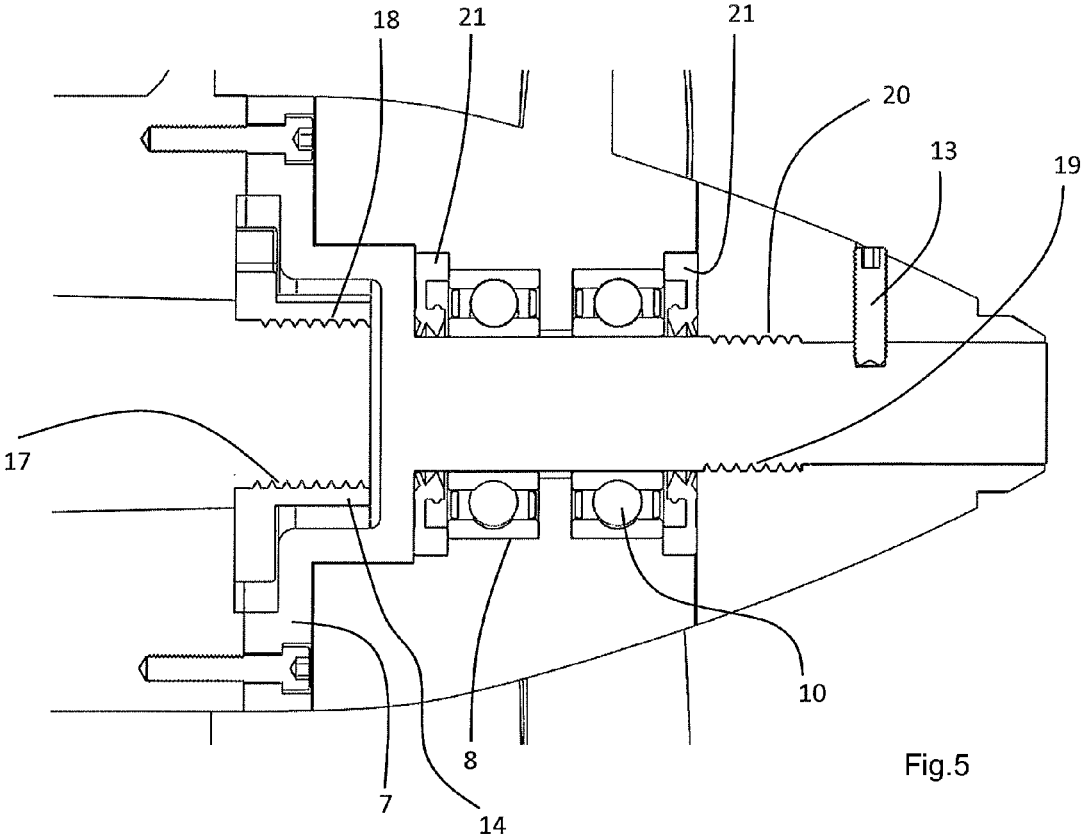
FIG. 5 shows a side sectional view of the propeller device according to the present invention.

The rear propeller is supported on a second shaft (6) by means of a support (10) being not rotatable in the direction of rotation and being free to rotate in the counter direction of rotation of the main shaft. The second shaft is coaxial with the main shaft (3). There is provided a space (11) inside the rear propeller hub (4) for receiving the support (10). The support (10) can be of any suitable support such as a ball bearing. As shown in FIG. 5, gaskets (21) can be arranged at lateral sides of the supports (10) for proofing water.

The second shaft (6) comprises a flange (7) extending radially outwardly on the side of the front propeller hub (1). This flange (7) is preferably monolithic with the second shaft (6), and the flange (7) is communicated with the front propeller hub (1) by means of a plurality of shaft hub connection bolts (9) annularly screwed. There is provided a clearance between the rear propeller hub (4) and the flange (7) for a frictionless rotation of the rear propeller in case the support (10) is not locked. A recess (8) is formed on the inner part of the flange for receiving the threaded part (17) of the main shaft. The external form of the rear propeller hub (4) has substantially a conical form so that the water resistance created thereon is minimized.

A conical member (12) is mounted alongside with the rear part of the rear propeller so as to decrease the water resistance. The external form of the conical member (12) is so designed that it will taper towards the end in accordance with the conical form of the rear propeller hub (4). The second shaft (6) has a threaded part (19), likewise, the conical member (12) having a central through bore, has a threaded part (20) on the bore surface, which are compatible with the threaded part (19) of the second shaft (6). For mounting the conical member (12) to the second shaft (6), threaded parts (19, 20) are screwed and then the conical member (12) is tightened by a wrench inserted through the end (16) of the conical member (12). Connection security of the conic member (12) is provided by means of a bolt (13) penetrating radially into a groove formed on the conical member (12) and the second shaft (6). There is provided a clearance between the rear propeller hub (4) and the conical member (12) for providing a frictionless rotation of the rear propeller.

In operation, water going out of the rear side of the front propeller is accelerated by means of the blades (2) of the front propeller, and this high-speed water hits the rear propeller blades (5) rotating the rear propeller. As the support (10) is locked in the rotational direction of the main shaft (3), torque created with the effect of the water hitting the rear propeller blades (5) is exerted on the second shaft (6) in the rotation direction of the main shaft (3). As the front propeller is accelerated, the rear propeller rotates faster because of the water energized by the front propeller, and the rotation speed of the second shaft (6) thus becomes higher than that of the main shaft (3). As the second shaft (6) is connected to the front propeller hub (1) by means of its flange (7), the torque created on the second shaft (6) is transmitted to the front propeller hub (1). Therefore, the torque provided to the front propeller by the vessel engine, so as to thrust the marine vessel decreases, which provides a better propeller thrust with less fuel consumption.

When the marine vessel navigates rearward, the main shaft rotates in the reverse direction, the support (10) will be free to rotate, providing an idle rotation of the rear propeller. Therefore, the rear propeller does not drag on water.

Figure 7:
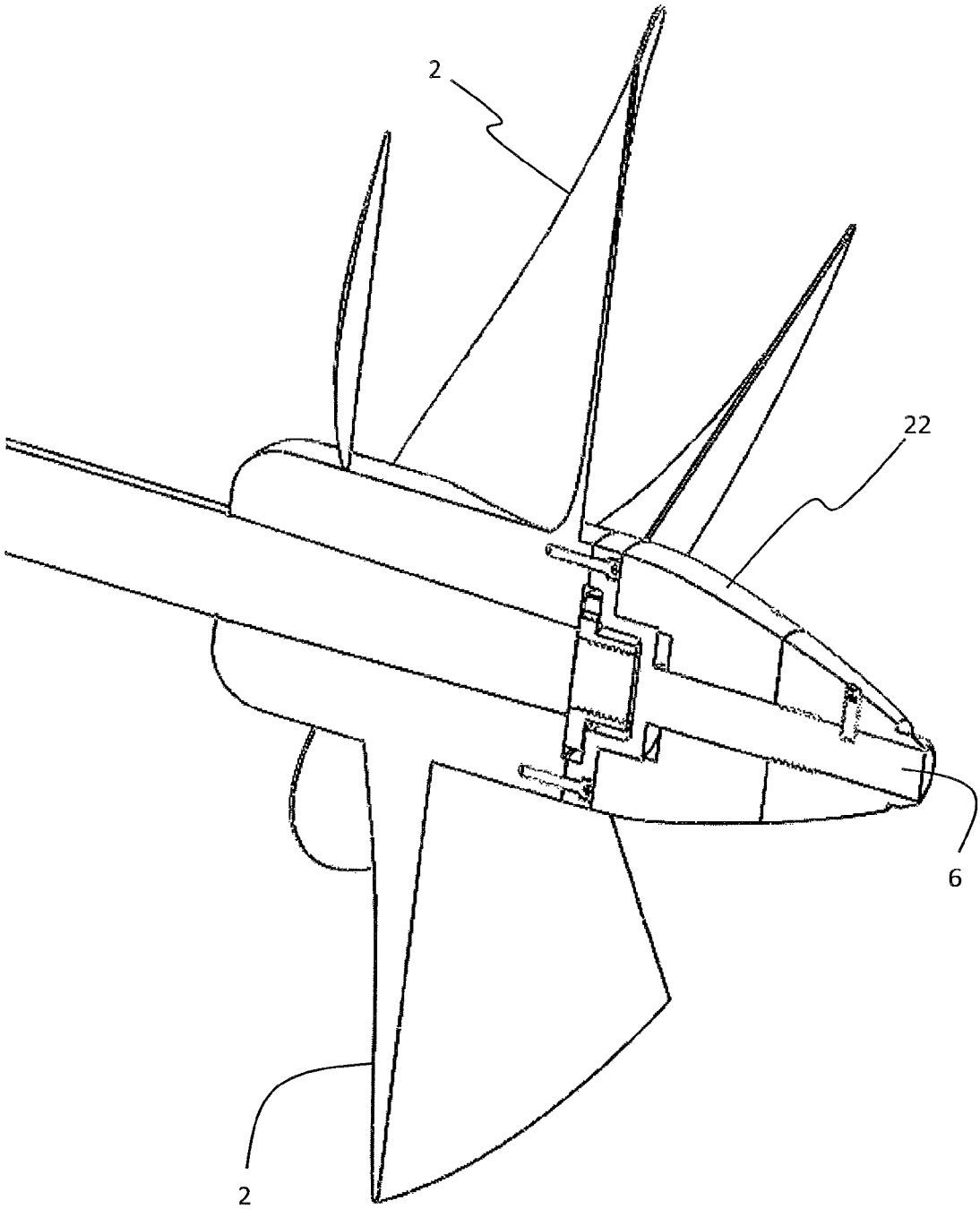
FIG. 7 shows the sectional view of the propeller device that is converted to a conventional propeller device.

The propeller device according to the present invention can be converted into a conventional monolithic structure without having the rear propeller. As shown in FIG. 7, this is achieved by removing the rear propeller and the supports (10), and a bladeless intermediate conic member (22) is mounted in place of the removed components. The inner part of the intermediate conic member (22) comprises a stepped cavity in a way that it preferably fits tightly on the flange (7) and the second shaft (6); or fits thereon then by means of a wedge connection as per appreciated by those in the art.

On the other hand, the propeller device according to the present invention can be applied to a conventional propeller, i.e. having a single propeller, in particular, when a single propeller becomes "heavy" for the marine vessel because of the high pitch thereof. In other words, the propeller device of the invention can be applied to a propeller which cannot receive enough torque from the main shaft. This is achieved by incorporating a rear propeller on the rear part of the high-pitch propeller.

Figure 6:
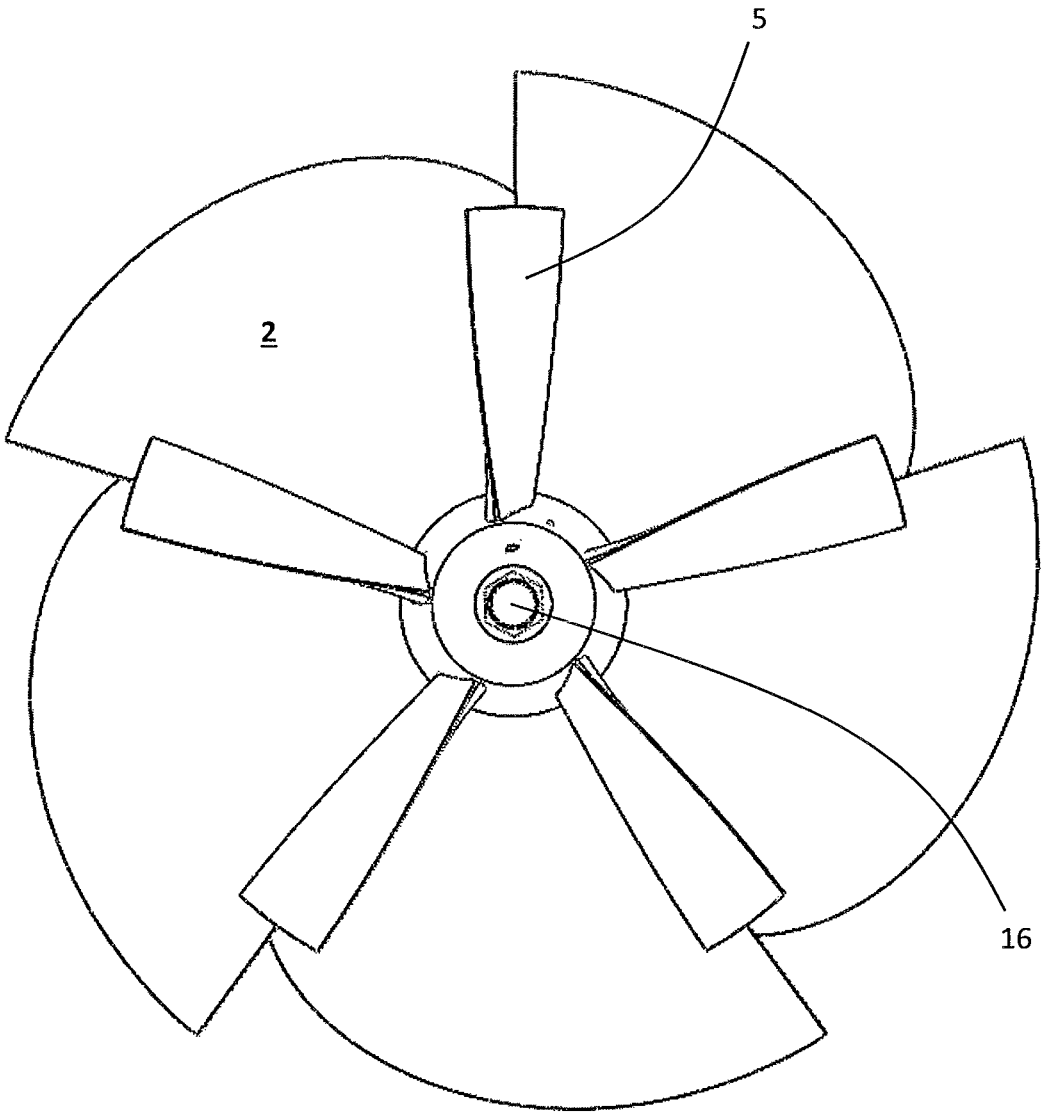
FIG. 6 shows the rear view of the propeller device according to the present invention.

As is shown in FIG. 6, the diameter of the rear propeller is preferably smaller than that of the front propeller.

This completes the description of the preferred and alternate embodiments of the invention. Those skilled in the art may recognize other equivalents to the specific embodiment described herein which equivalents are intended to be encompassed by the claims attached hereto.

What is claimed is:

1. A propeller device for a marine vehicle, the propeller device comprising:

a front propeller for mounting on a main shaft (3) communicating with a drive engine of the marine vehicle, the front propeller having a hub (1) and a plurality of blades (2) extending radially outwardly from the hub (1);

a rear propeller being co-axially to and spaced from the front propeller, the rear propeller having a hub (4) and a plurality of blades (5) extending radially outwardly from the hub (4);

a second shaft (6) fixedly communicating with the front propeller hub (1);

at least one support (10) for supporting the rear propeller on the second shaft (6), the at least one support preventing the second shaft (6) from rotating in the direction of rotation of the main shaft (3) when the marine vessel travels in a forward direction and being free to rotate thereof in the counter direction of rotation of the main shaft (3) when the marine vessel travels in a backward direction.

2. A device according to claim 1, wherein the second shaft (6) comprises a flange (7) extending radially outwardly therefrom for communicating the second shaft (6) with the front propeller hub (1).

3. A device according to claim 1, wherein the rear propeller hub (4) comprises a substantially conical form.

4. A device according to claim 3, wherein a conical member (12) provided alongside with the rear propeller, the conical member (12) comprising a conical form being compatible with the conical form of the rear propeller hub (4).

5. A device according to claim 4, wherein the conical member (12) comprises a central through bore and a threaded part (20) formed on the surface of the bore, the threaded part (20) on the bore surface being constructed and arranged for engagement to the threaded part (19) of the second shaft (6).

6. A device according to claim 1, wherein the second shaft (6) comprises a threaded part (19).

7. A device according to claim 1, wherein the diameter of the rear propeller is smaller than the diameter of the front propeller.

8. A device according to claim 1, wherein the at least one support (10) is a ball bearing.

9. A device according to claim 1, wherein the rear propeller and the at least one support (10) can be replaceable with a bladeless intermediate conical member (22).

10. A marine vessel including a propeller device according to claim 1.

* * * * *